United States Patent [19]

Allen et al.

[11] Patent Number: 4,538,863

[45] Date of Patent: Sep. 3, 1985

[54] INDUCTIVE CONNECTORS

[75] Inventors: John Allen; David Pearce, both of Avon, England

[73] Assignee: Marconi Avionics Limited, England

[21] Appl. No.: 408,671

[22] Filed: Aug. 13, 1982

[30] Foreign Application Priority Data

Aug. 17, 1981 [GB] United Kingdom ..... 8125057

[51] Int. Cl.[3] ..... H01R 11/30

[52] U.S. Cl. ..... 339/12 R

[58] Field of Search ..... 339/12 R, 12 L

[56] References Cited

U.S. PATENT DOCUMENTS

| | | | |
|---|---|---|---|
| 1,121,293 | 12/1914 | Sachs | 339/12 L |
| 1,312,092 | 8/1919 | Arter | 339/12 R |
| 1,441,193 | 1/1923 | Wyman | 339/12 R |
| 1,523,498 | 1/1925 | Stark | 339/12 L |
| 3,171,091 | 2/1965 | Goldsmith | 339/12 R |
| 4,025,964 | 5/1977 | Owens | 339/12 R |

FOREIGN PATENT DOCUMENTS

| | | | |
|---|---|---|---|
| 11832 | 7/1889 | United Kingdom | 339/12 R |
| 2020116 | 9/1982 | United Kingdom . | |

*Primary Examiner*—Gil Weidenfeld
*Assistant Examiner*—Paula A. Austin
*Attorney, Agent, or Firm*—Kirschstein, Kirschstein, Ottinger & Israel

[57] ABSTRACT

A make and break inductive connector for transferring electrical energy, e.g. under water, by transformer action comprising two separable body parts (11) having mateable end faces (13). Each part has a cavity (15) extending into it from its end face and a magnetic pot core half (17) housed in the cavity so that the end of the pot core half is flush with the body part end face. Within an annular cavity (23) of each core half there is housed a toroidal electrical winding (25) and potting compound occupies the otherwise free space of the body part cavity, including the cavity in the pot core half, so as to enclose the winding completely and preclude direct contact between the winding and the pot core half.

6 Claims, 4 Drawing Figures

INDUCTIVE CONNECTORS

This invention relates to make and break inductive connectors for transferring electrical energy.

Such connectors comprise two separable parts each incorporating an electrical winding so that when the two parts are brought together electrical energy supplied to one winding is transferred to the other winding by transformer action. Such connectors find particular application in underwater electric power lines, and are often required to operate at considerable depths and hence under high hydrostatic pressures in remote and inaccessible locations. Thus reliability is of extreme importance in such connectors.

In is an object of the present invention to provide a make and break inductive connector for transferring electrical energy which is of improved reliability.

According to the present invention, in a make and break inductive connector for transferring electrical energy comprising two separable parts adapted to be brought together so that electrical energy can be transferred from one part to the other by transformer action, each said part comprises: a body portion of generally cylindrical form having a cavity extending therein from an end face adapted to mate with the corresponding face of the body portion of the other part; within said cavity a magnetic core member of generally cylindrical form having an annular cavity extending therein from an end face, said end face of the core member being at least approximately flush with said end face of the body portion; a toroidal electrical winding, for external connection, disposed in said core member cavity; and a matrix of a potting compound occupying the otherwise free space within said body portion cavity, including the cavity of the core member, so as to enclose completely said winding, and preclude any direct contact between the winding and the core member.

In a connector according to the invention, each winding is completely isolated against contact by environmental fluid, e.g. water, which may enter a body portion, in particular, fluid entering at the interface between the potting compound and the surface of the core member.

Preferably the winding is a bobbinless winding.

Preferably, in each connector part said winding is disposed between said end face of the core member and the base of said cavity in the core member.

In each core member spacer means composed of the same material as said potting compound is preferably disposed between the winding and the base of the cavity in the core member.

One submarine inductive connector in accordance with the invention will now be described, by way of example, with reference to the accompanying drawings in which.

Figure 1:
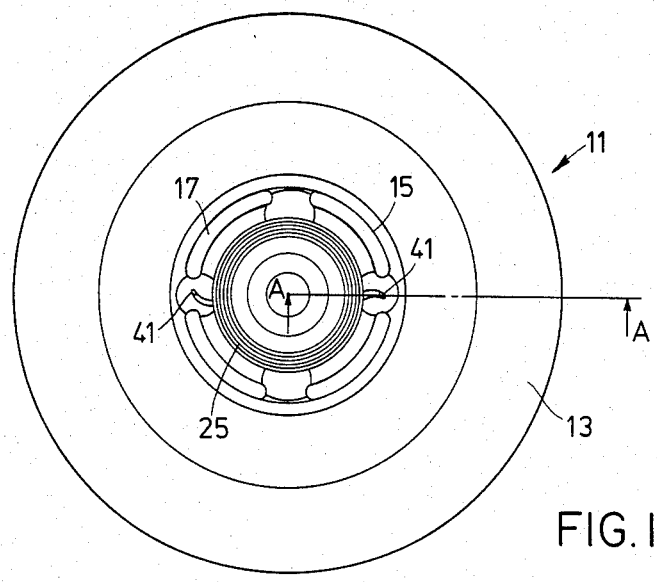
FIG. 1 is an end elevation of one part of the connector.

The connector comprises two essentially similar parts, only one 11 of which is shown in the drawings. The parts, as 11, each have a body portion 28 of generally cylindrical form having a planar endface 13, which in use of the connector mates with the corresponding face of the other part, in abutting relationship. Extending into each body portion 28 from its endface 13, there is a main cavity 15. Within each main cavity 15 there is a magnetic core member comprising half a conventional ferrite pot core 17 the free end surfaces 19, 21 at the open end of which are approximately flush with the endface 13. Within the annular cavity 23 of each ferrite pot core half 17 there is a toroidal electrical winding 25 of enamel coated wire. A matrix of potting compound (not shown), e.g. epoxy resin, occupies the otherwise free space within each main cavity 15, including the annular cavity 23 of the pot core half 17, so as completely to enclose the winding 25, and preclude direct contact between the winding and the core.

The body portion 28 of each connector part suitably comprises an epoxy resin moulding.

The ferrite pot core halves 17 themselves are inert to corrosion in normal sea water. They are, however, relatively brittle and prone to fracture under stresses which develop in a pottng compound during encapsulation. They have, moreover, a poor adhesion to usual encapsulation materials such as epoxies. It must therefore be assumed that moisture will always be present round the ferrite cores 17 even if encapsulated.

The enamel coating of the wire of the windings 25 is subject to the development of micro-cracks, particularly on the outside surface of bends in the wire. In the absence of additional protection, the windings are therefore prone to insulation breakdown in moist conditions, and the provision of such additional protection is essential.

The solution to these difficulties has been found to be the provision of a potting compound matrix to enclose the winding 25 and isolate it from the ferrite core 17.

Potting is done preferably in a single injection in order to avoid interfaces between successive layers of potting compound. The potting compound should be a material that introduces low stress during its cure cycle, i.e. possess low cure shrinkage, and can be cured using a low temperature long duration cure cycle. The volume of the encapsulant should also be kept to a minimum. This prevents stresses being set up during the encapsulation process which may cause cracking of the ferrite core and cause stress cracking in the encapsulation itself. Cracking referred to here can be micro cracks not apparent by simple visual inspection, but which will introduce porosity into the encapsulation and hence cause breakdown of insulation of the winding.

Each winding 25 is a bobbinless pre-formed winding with fixed length flying leads 31. The leads 31 are used to assist in positioning the winding 25 to achieve coaxiality with the central projection 33 of the ferrite port core half 17 to avoid contact with the side walls of the cavity 23 in the core 17.

Figure 2:
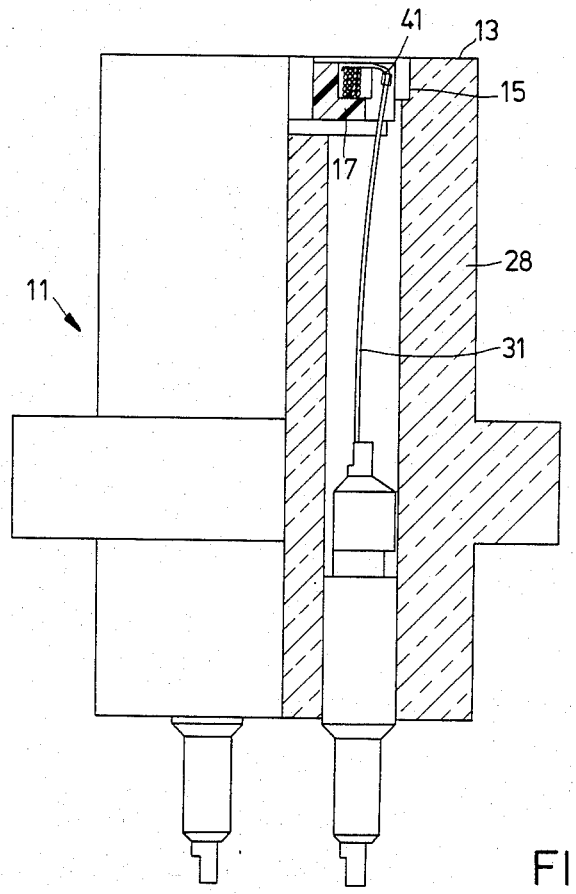
FIG. 2 is a side elevation of the connector part of FIG. 1 part sectioned on the A—A in FIG. 1.
Figure 3:
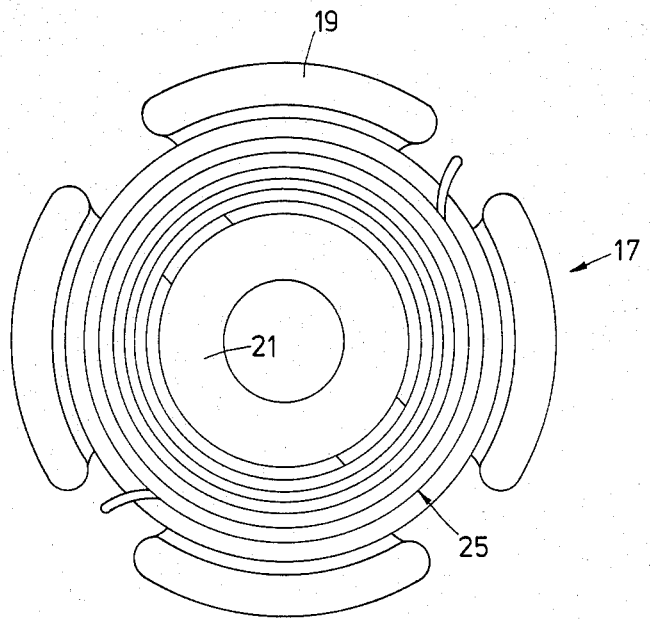
FIG. 3 is an end elevation of a core member forming part of the connector part of FIGS. 1 and 2.
Figure 4:
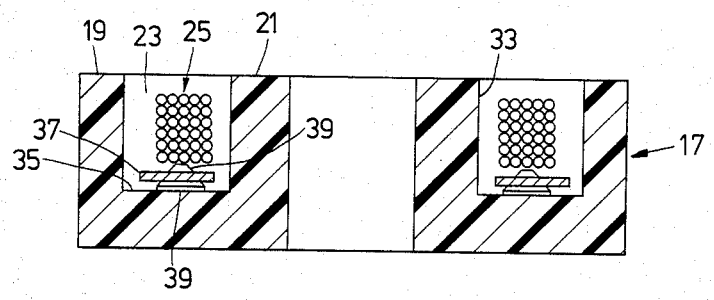
FIG. 4 is a sectional side elevation of the core member.

The winding 25 is disposed in the cavity 23 in the port core half 17 so that, as shown in FIGS. 2 and 4, its upper surface lies below the top surfaces 19, 21 of the core half 17 and its bottom surface lies above the base 35 of the cavity 23. The winding 25 can then be completely enclosed in encapsulant without the encapsulant protruding above the level of the upper end of the pot core half 17.

Spacing of the winding 25 from the base 35 of the cavity is difficult in that even though the winding is suspended by its flying leads and is prevented from horizontal movement it still has some degree of freedom in the vertical plane. Thus the winding 25 may come to rest on the base 35 during encapsulation unless some further action is taken.

Isolation of the winding 25 from the base 35 by rigidly fixing the winding above the base, preventing vertical movement, has been found to be impracticable. Therefore washers 37 of epoxy, are preferably introduced into the cavity 23 between the winding 25 and the base 35. The washers 37 are of the same composition as the encapsulant and are rigid and hence prevent any physical contact between the winding 25 and the ferrite core base 35.

Prior to insertion, each washer 37 may be "pre-wet" with an epoxy of the same composition as the encapsulant. Both top and bottom of the washer may be so treated. The washer 37 is introduced into the cavity 23 so as to come to rest spaced from the ferrite core base 35 by the wetting epoxy 39. The winding 25 is then positioned by its flying leads as mentioned previously. The encapsulation process, using an epoxy having the properties previously mentioned, is then performed prior to the gel state of the pre-wetting resin. This ensures an amalgamation of the pre-wetting resin and the final encapsulant at this stage.

If the resin has a low viscosity it may not support the washer 37 as shown diagrammatically in FIG. 4. It is therefore possible that the washer 37 will make contact with the ferrite core base 35 and the winding 25 will make contact with the washer 37 if the winding settles. However, on encapsulation the pre-wetting of the surfaces will aid in the flow of encapsulant over these surfaces, creating a construction as indicated in FIG. 4. Should the winding 25 contact the washer 37 and the washer 37 contact the ferrite core base 35, isolation is provided solely by the adhesion of the encapsulant to the washer 37. Bearing in mind the possibly essential nature of this adhesion surface the washers 37 are treated with the utmost care and are kept in sealed pollutant-free containers from manufacture until assembly into the ferrite core, which is carried out with clean instruments.

Whilst pre-wetting as described is an aid, encapsulation over the interface surfaces (winding-washer-ferrite core) can in fact be accomplished using "dry washers".

Soldered joints 41 between the bared winding ends and the flying leads 31 are positioned such that they are not proud of the upper encapsulation surface.

The bared winding ends are positioned in gaps in the core side wall such that they and the solder joints are nowhere touching the core 17 or the body portion 11.

In use the two connectors parts 11 normally have only their faces 13 exposed to the water environment, the body portions 28 being otherwise enclosed in respective housing (not shown) filled with a dielectric fluid, the housings being sealed to the body portions 28 by "O" rings (not shown).

We claim:

1. A make and break inductive connector for transferring alternating current electrical energy, said connector comprising (A) two separable parts, each comprising
  (i) a body portion
  (ii) a magnetic core member housed in said body portion, and
  (iii) a winding associated with said core member;

(B) said two parts being adapted to be brought together so that the core members of the two parts together form a magnetic circuit linking the two windings of said two parts so that electrical energy can be transferred from one part to the other by transformer action between the two windings; and (C) wherein, in each said part
  (i) said body portion is of generally cylindrical form having a cavity extending therein from an end face adapted to abut the corresponding face of the body portion of the other part when said two parts are brought together,
  (ii) said magnetic core member is disposed within said cavity and is of generally cylindrical form with an annular cavity extending therein from an end face,
  (iii) said end face of the core member is at least approximately flush with said end face of the body portion;
  (iv) said winding is of toroidal form and is disposed in said core member cavity, and
  (v) a matrix of a potting compound occupies the otherwise free space within said body portion cavity, including the cavity of the core member, so as to enclose completely said winding, and preclude any direct contact between said winding and the core member.

2. A connector according to claim 1 wherein said winding is a bobbinless winding.

3. A connector according to claim 1 wherein said winding is disposed between said endface of the core member and the base of said cavity in the core member.

4. A connector according to claim 1 including spacer means composed of the same material as said potting compound and disposed between the winding and the base of the cavity in the core member.

5. A connector according to claim 1 wherein the potting compound is an epoxy resin.

6. A connector according to claim 1 wherein said core member is a ferrite pot core half.

* * * * *